US005312501A

United States Patent [19]

Gruber et al.

[11] Patent Number: 5,312,501

[45] Date of Patent: May 17, 1994

[54] AUTOMATED LINER REMOVING TRANSFER TAPE APPLICATOR METHOD

[75] Inventors: Michael W. Gruber, Woodbury, Minn.; Robert A. Luhman, Deer Park, Wis.

[73] Assignee: Minnesota Mining and Manufacturing Company, St. Paul, Minn.

[21] Appl. No.: 568,842

[22] Filed: Aug. 17, 1990

Related U.S. Application Data

[62] Division of Ser. No. 148,845, Jan. 27, 1988, Pat. No. 4,980,011.

[51] Int. Cl.[5] ..... B32B 31/00

[52] U.S. Cl. ..... 156/238; 156/249; 156/344; 156/540

[58] Field of Search ..... 156/238, 249, 540, 584, 156/247, 344

[56] References Cited

U.S. PATENT DOCUMENTS

| | | | |
|---|---|---|---|
| 2,845,041 | 2/1958 | Karn . | |
| 3,539,419 | 11/1970 | Stageberg . | |
| 3,765,992 | 10/1973 | Stageberg . | |
| 3,839,127 | 10/1974 | Hazuka et al. . | |
| 3,892,618 | 7/1975 | Griebat | 156/577 |
| 3,969,181 | 7/1976 | Seabold | 156/577 |
| 3,992,244 | 11/1976 | Craig et al. | 156/584 X |
| 4,077,827 | 3/1978 | Jones et al. . | |
| 4,131,501 | 12/1978 | Böttcher et al. . | |
| 4,220,495 | 9/1980 | Uchida . | |
| 4,255,218 | 3/1981 | Stageberg . | |
| 4,295,916 | 10/1981 | Stevens | 156/397 |
| 4,447,482 | 5/1984 | Heinzelman et al. . | |
| 4,452,659 | 6/1984 | Geurtsen et al. | 156/361 |
| 4,459,170 | 7/1984 | Kerwin . | |
| 4,566,933 | 1/1986 | Crankshaw et al. . | |
| 4,718,971 | 1/1988 | Summers | 156/584 X |
| 5,006,184 | 4/1991 | Manusch et al. | 156/584 X |

FOREIGN PATENT DOCUMENTS

| | | |
|---|---|---|
| 2504A81 | 1/1981 | Spain . |
| 1194038 | 9/1967 | United Kingdom . |

OTHER PUBLICATIONS

Perma-Tork Hollow Shaft Units (HC/EC 2, 4, 5) Instructions-Bulletin WEB-503, Jan. 1985.

L2 Light Series Spec Sheet "Cold Spring Type" from Power/Mation.

*Primary Examiner*—David A. Simmons
*Assistant Examiner*—Mark A. Osele
*Attorney, Agent, or Firm*—Merchant, Gould, Smith, Edell, Welter & Schmidt

[57] ABSTRACT

An automatic application device for dispensing an adhesive transfer tape with the liner removed includes a hub for rotatably supporting a roll of adhesive transfer tape and an application head for pressing the adhesive transfer tape unwound from the roll onto a product to which it is to be applied. An idler roller is disposed above the application head to pull the liner away from the application head. A motor driven take-up roller and corresponding nip roller are provided to pull the liner along its path over said idler roller away from the application head. A brake roller is provided along the path of the transfer tape between the roll and the application head to selectively stop the tape's advance. When the brake roller is released, the product to which the adhesive is applied pulls the tape underneath the application head, unwinding it from the roll. When the brake roller is stopped, the tape stops advancing and the adhesive strip carried on the liner is broken. A compensation roller provides that when the head is lifted the tape is maintained in a fixed position relative to the head so that the leading edge of the adhesive on the tape liner returns to the proper position when the head is lowered.

6 Claims, 3 Drawing Sheets

AUTOMATED LINER REMOVING TRANSFER TAPE APPLICATOR METHOD

This is a division of application Ser. No. 07/148,845, filed on Jan. 27, 1988, now U.S. Pat. No. 4,980,011.

TECHNICAL FIELD OF THE INVENTION

This invention relates to an automatic application device capable of dispensing an adhesive transfer tape with the liner removed.

BACKGROUND OF THE INVENTION

Adhesive transfer tape comprises a strip of adhesive releasably supported on a liner. The adhesive is transferred to a substrate by pressing the tape onto the substrate and removing the liner. The exposed surface of the transferred adhesive is thus readied to bond the substrate to another surface. Various devices have been devised for dispensing an adhesive transfer tape with the liner removed. A manual, hand-held device of this type is disclosed in U.S. Pat. No. 3,969,181. That device is a manually activated applicator in which the liner is led around an application roller and then wound on a take-up reel. The application roller is manually rolled over a surface to which the adhesive is to be applied, causing adhesive on the liner passing around the roller to transfer to the surface and simultaneously drive the wind-up mechanism to collect the liner. An automatic device for dispensing an adhesive transfer tape with the liner removed is disclosed in U.S. Pat. No. 4,255,218. In this device, the adhesive transfer tape is automatically advanced over an application head. The substrate to which the adhesive is to be transferred is pressed against the tape running across the application head. The movement of the tape over the head advances the substrate as the adhesive is separated from the liner and transferred to the substrate.

SUMMARY OF THE INVENTION

The present invention provides an automatic application device for dispensing an adhesive transfer tape with the liner removed. The device includes hub means for rotatably supporting a roll of adhesive transfer tape, an application head supported for pressing the adhesive transfer tape onto a product to which it is to be applied, liner removal means for pulling the liner of the tape away from the application head, and brake roller means disposed in the path of the tape between the roll and the application head for selectively stopping the advance of the tape and breaking the adhesive. The device according to the present invention is operable to apply adhesive from the tape to a product as the product is advanced underneath the head. The advance of the product pulls the tape underneath the applying head, pulling it from the tape roll. The liner of the tape is retracted and removed from the head by the liner removal means, which provides a pulling force on the liner. The brake roller means can be selectively activated to stop the advance of the tape over the application head so that the adhesive strip on the liner is severed. A selected length of adhesive may thereby be transferred from the adhesive transfer tape to the product being advanced underneath the application head.

According to another aspect of the invention there is included unwind tensioning means for maintaining a substantially constant unwind tension on the tape. The unwind tensioning means may include an unwind motor connected to drive the hub means to help maintain a constant unwind tension.

According to yet another aspect of the invention, the unwind tensioning means includes an unwind dancer arm having a dancer take-off pin for separating the adhesive from the back side of the tape liner. The unwind motor may include control means responsive to the position of the unwind dancer arm so that the speed of the unwind motor changes as the dancer arm is moved from its neutral position by the movement of the tape.

According to still another aspect of the invention, the liner removal means comprises an idler roller positioned above the application head means and a take-up roller and nip roller biased thereagainst with the tape travelling over said idler roller and advancing between the take-up roller and said nip roller. The take-up roller is preferably motor driven through a slip clutch to provide a predetermined, constant liner removal tension on said liner and for rapid acceleration of the liner.

According to yet another aspect of the invention means are provided to raise and lower the head on and off the product.

According to still another aspect of the invention there is provided means for maintaining a constant tape path length between said brake roller and said head when it is raised and lowered so that the leading edge of the adhesive on the tape stays in its home position on the tangent point of said head when said head is moved.

BRIEF DESCRIPTION OF THE DRAWING

The invention will be further described with reference to the accompanying drawing wherein like numerals refer to like parts in the several views, and wherein.

DETAILED DESCRIPTION OF THE PREFERRED EMBODIMENT

Figure 1:
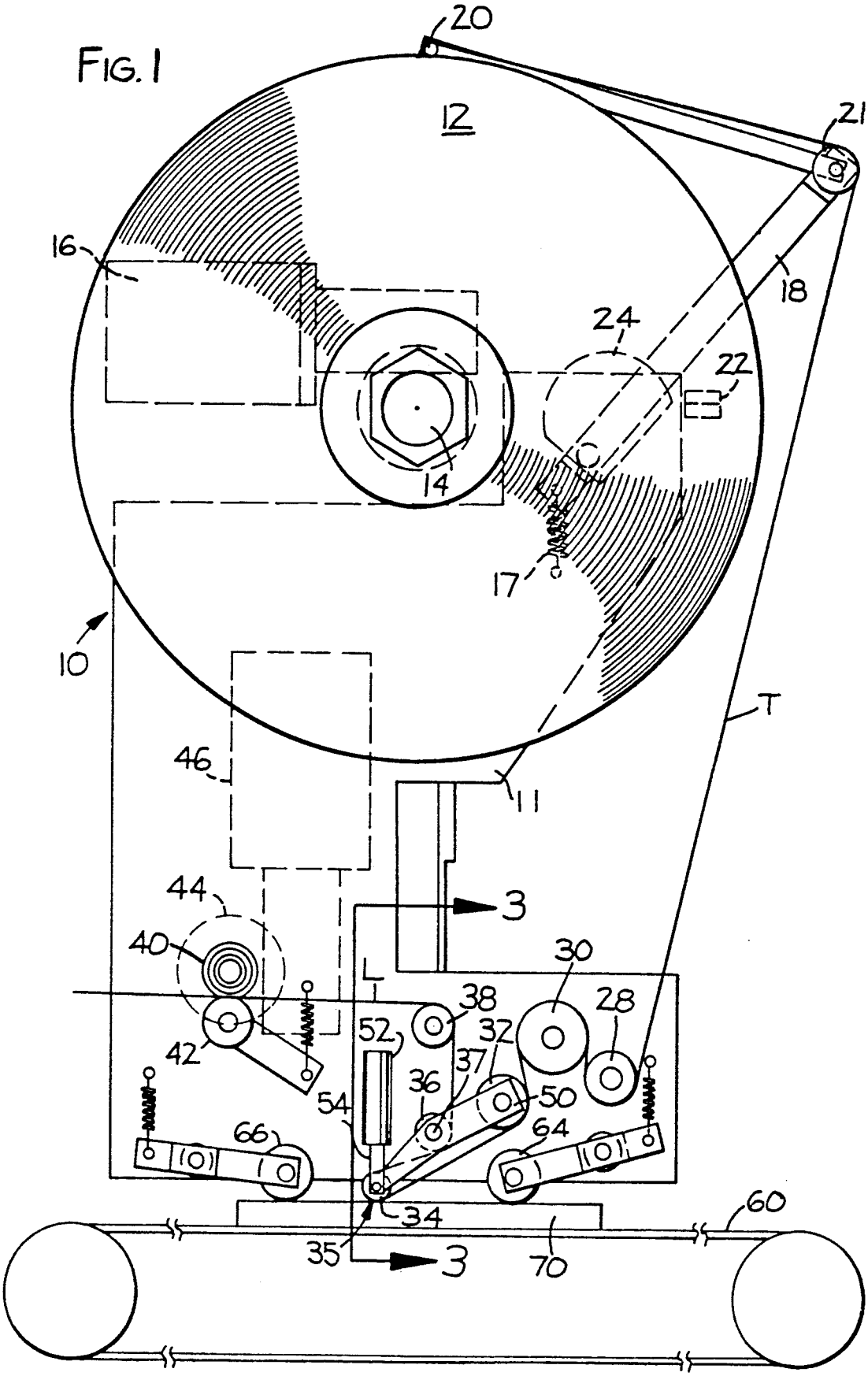
FIG. 1 is an elevational front view of an adhesive applying device according to the present invention.
Figure 3:
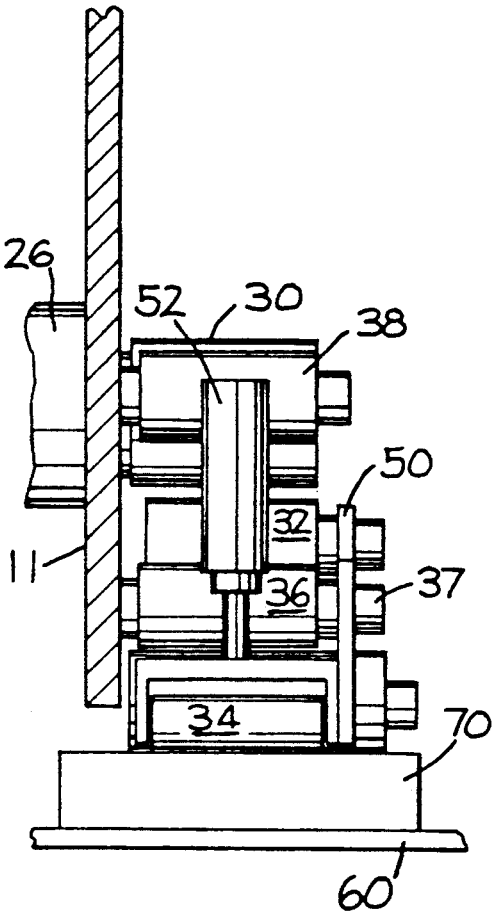
FIG. 3 is a cross-sectional view taken along lines 3—3 of FIG. 1.
Figure 2:
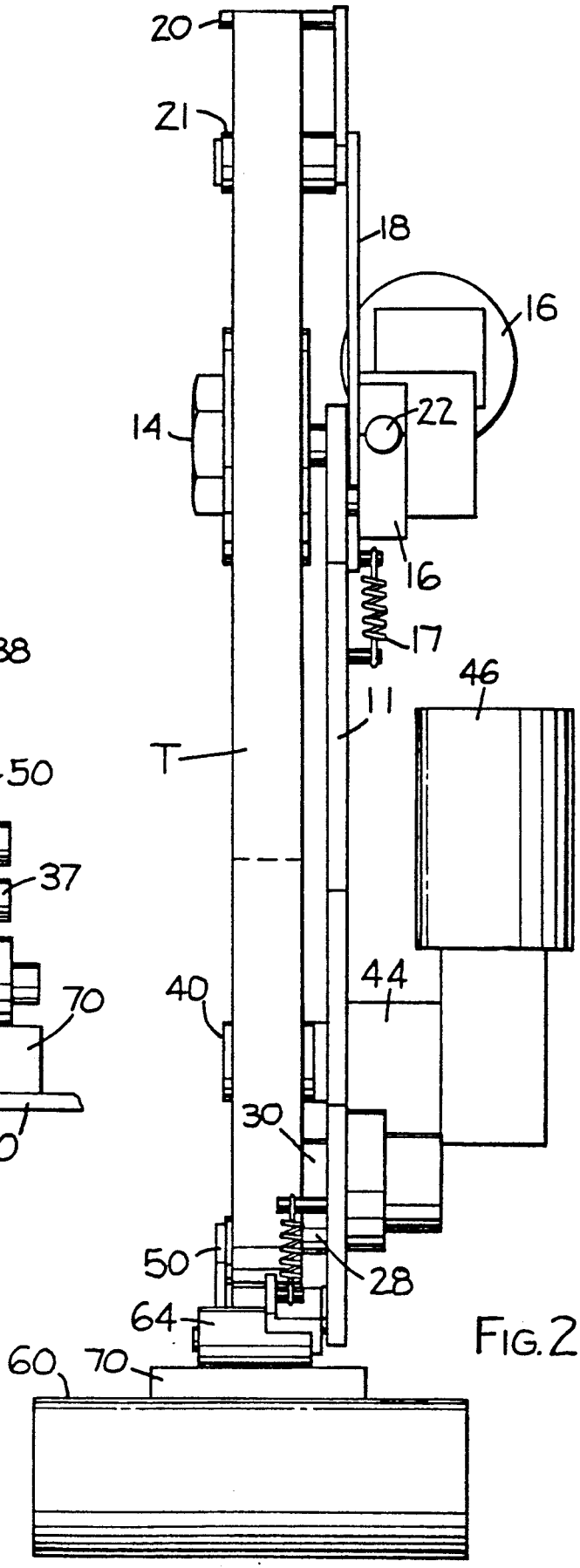
FIG. 2 is an elevational side view of the device according to FIG. 1.

Referring now to the drawing, there is shown automated liner removing transfer tape applicator 10 according to the present invention. The device 10 includes a frame 11 for supporting the various components thereof. A hub 14 carries a tape roll 12 of tape T. Tape T is unwound over take-off pin 20 and roller 21 of dancer arm 18. It continues to travel around wrap roller 28 over brake roller 30 and under wrap roller 32 to the application head 34, which is shown as comprising a roller. Tape T continues its travel around head 34 underneath idler roller 36, over roller 38 and between liner take-up roller 40 and nip roller 42.

In dispensing operation, the application head 34 is pressed against a moving product 70 which pulls the tape T underneath the application head 34 thereby unwinding it from tape roll 12. The take-up forces applied by take-up roller 40 pulls liner L of tape T up and away from the surface of the product 70 to separate the liner from the adhesive carried thereon. Supply side brake roller 30 is provided to stop the advance of tape T under application head 34 and thereby break the adhesive strip supported on the liner L as the product continues advancing. When tape T is locked by brake roller 30, tape liner L skids along the surface of product 70 unless application head 34 is lifted.

Application head 34 and wrap roller 32 are mounted on yoke 50. Yoke 50 is pivotally mounted to frame 11 on axle 37 which also supports roller 36. Thus, the yoke 50 pivots intermediate between the application head 34 and wrap rollers 32. Yoke 50 is activated by piston 54 of air cylinder 52 to press application head 34 onto product 70 and to lift head 34 when desired. When roller 34 is moved up and down, wrap roller 32 moves in a complimentary direction. This motion is designed to maintain a constant tape path length between brake roller 30 and the take-up roller 40 for all positions of yoke 50. Wrap roller 32 thus also serves as a tape path length compensation roller. The importance of maintaining a fixed path length will be explained further below.

In the embodiment of device 10 disclosed herein the head 34 can be lifted between applications of adhesive. This operation may be necessary or desirable in many cases for instance to lift the head over a recess or gap in or between product 70 moving on the conveyor. It is not necessary, however, to lift the head between applications; when the brake roller 30 is applied the liner can skid along the surface of product 70 until the next spot on the product where adhesive is to be applied.

Proper unwind tension is provided on tape roll 12 with unwind motor 16 and dancer arm 18. In the embodiment shown herein, unwind motor 16 is a DC gear motor that drives the hub 14 in a counterclockwise direction to help control unwind tension. The unwind motor is controlled by proximity switch 22, which has an analog output. A cam 24 is provided on dancer arm 18 for actuating proximity switch 22 a variable amount depending upon the position of dancer arm 18. This system is designed to control the speed of unwind motor 16 in accordance with the position of dancer arm 18 to maintain it in its neutral position shown in FIG. 1 and thereby prevent slack in the unwinding tape T and provide desired tension.

A brake 26 is provided to control the rotation of brake roller 30. Brake 26 when engaged stops brake roller 30 from rotating. When released brake roller 30 can freely rotate. Wrap rollers 28 and 32 provide the necessary wrap on the brake roller 30, thereby providing ample contact area between the brake roller and the tape to prevent skidding and distortion of the adhesive when the brake is applied. Liner take-up roller 40 is driven by constant speed take-up motor 46 through a slip clutch assembly 44, which allows for rapid acceleration of the roller 40 to remove liner. Slip clutch 44 also provides a continuous, predetermined, constant pull tension on the liner. Although not shown in the drawings, a vortex tube is preferably provided to vacuum liner exiting rollers 40 and 42 into a waste receptacle.

Figure 4:
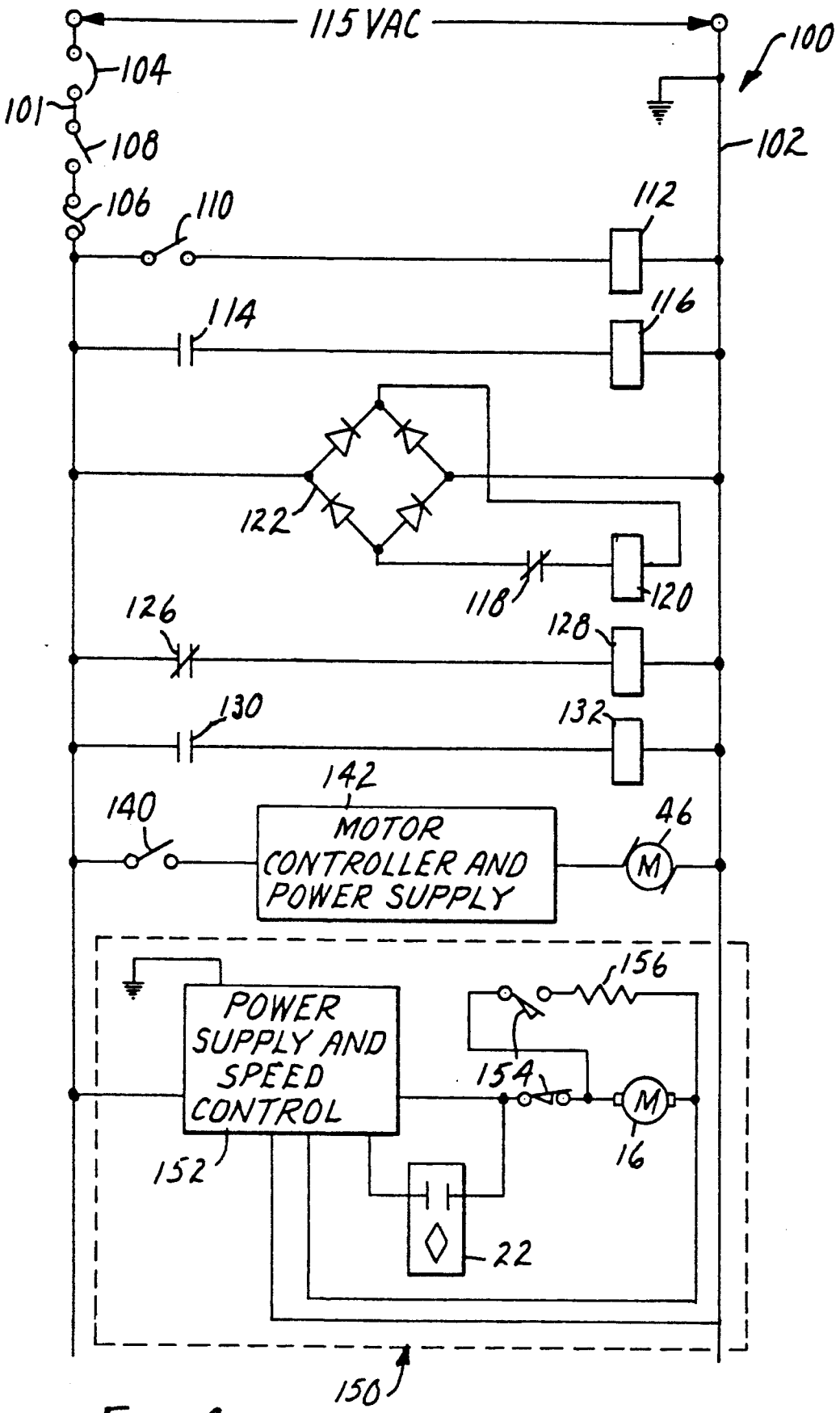
FIG. 4 is a schematic diagram of the control circuit of the device of the present invention.

Referring now to FIG. 4, the electrical circuit of tape applicator will be described. This circuit is designed to lift head 34 between adhesive applications. It shall be understood, however, that the circuit could be readily modified so that head 34 stays down and only brake roller 30 is turned on and off to control adhesive application from the tape T. Electrical circuit 100 includes first and second sides 101 and 102 across which is connected a 115VAC power supply. Power is supplied through circuit breaker 104 to the main ON/OFF switch 108 and is fused through 2-amp fuse 106. Switch 110 is used to start and stop the operation of device 10 while the device is powered up through relay 108. In a typical application of the present invention switch 110 would be product activated. For this operation switch 110 would be positioned near the conveyor to be activated by the product moving on the conveyor. Switch 110 would also be sensitive to the product moving out of position to stop the application of adhesive, or a separate shut off switch could be used in combination with switch 110 for this purpose. Mechanical, photo-optic and proximity type switches would all be suitable for use as switch 110.

When switch 110 is closed, switch 110 activates relay coil 112, which throws relay 114. Relay 114 activates 0.1 second time delay coil 116 subsequently opening relay 118 after the delay period and deactivating brake coil 120, which is supplied a DC voltage via rectifier 122. The activation of coil 112 also opens relay 126. When relay 126 is opened coil 128 is deactivated, opening relay 130. When relay 130 opens, coil 132 deactivates, causing the solenoid valve controlling air flow to cylinder 52 to switch and cause the cylinder 52 to extend piston 54 and lower head 34. When switch 110 is opened, relay 126 is closed. Coil 128 thereafter delays for a period of 0.2 second and then closes relay 130. When relay 130 closes, the solenoid switches "on" and redirects the air flow to cylinder 52, causing piston 54 to retract and lift head 34. Thus, the system is configured to cause the immediate extension of piston 54 and descent of application head 34 upon the closing of switch 110 with the brake coil 120 being released 0.1 seconds thereafter. This delay allows the application head 34 to develop sufficient adhesive transfer pressure on the surface of product 70 before the tape is permitted to advance. A complete transfer of the leading edge of the adhesive is thereby achieved. When switch 110 is opened, brake 120 is applied without delay while the application head is delayed for 0.2 seconds so that the adhesive strip on the tape T is cleanly broken before the head is lifted.

Switch 140 is also provided to control the application of power to the motor controller and power supply 142 for rewind motor 46. The unwind motor control circuit 150 comprises a power supply and speed control circuit 152, proximity switch 22, motor ON/OFF relays 154, motor 16, and a dynamic brake resistor 156 attached across the poles of motor 16 to brake the tape roll for attenuating overcoast.

The application head 34 shown in the embodiment disclosed herein comprises a roller. However, the application head may consist of a shoe as, for example, shown in U.S. Pat. No. 4,255,218 referenced above. Whether a hard roller, soft roller or shoe-type application head is used, the applying pressure must be maintained at sufficiently high levels to assure reliable transfer of adhesive from the tape to the product. In general, the required pressure will vary depending upon the particular transfer tape being used but for most Scotch® brand adhesive transfer tapes 240 psi is found to be suitable. Scotch® brand adhesive transfer tapes known to work in connection with the adhesive transfer device disclosed herein include products No. 920; 465; 465XL; 950; 9485; and 9482, as available from Minnesota Mining and Manufacturing Company of St. Paul, Minnesota. The above-identified tapes have been run at ½-inch and 1-inch widths.

It has been found for all adhesive transfer tapes tested that it is critical that there be proper applying pressure before the roller brake is released, or else the adhesive tends to stay on the liner. Also, it has been found that if the tape T is allowed to loop as it leaves head 34 the liner has a tendency to stay on the adhesive strip stuck to the product and thus disrupt proper liner take-up operation. Thus, looping needs to be minimized. In this regard it has been found that the looping of the liner as it is retracted away from the application head 34 is not only controlled by the rewind tension, but also by the unwind tension.

In addition to minimizing looping, it is also very important that the leading edge of the adhesive on the tape T be at the tangent point 35 of head 34 when the brake roller 30 is released to initiate adhesive application. The tangent point is defined by the actual contact between the applying head and the product, which would take the shape of a rectangular strip. In the case of application heads made of deformable materials, the width of the strip would vary according to the degree to which the head is pressed on the product. If at the outset of tape dispensing the leading edge of the adhesive on the liner is forward of the tangent point the liner will tend to stay on the adhesive transferred to the product surface and not be properly retracted as the product moves under head 34. This failure to properly retract the liner can cause device 10 to malfunction. If the adhesive edge is behind the tangent point, the adhesive will not catch on the product passing under the head to initiate dispensing.

In constant head down operation wherein the head 34 is not lifted between adhesive applications, tape T maintains a steady enough position so that the adhesive stays at the critical tangent point on head 34. If the head is lifted, as between applications, however, care must be taken to assure that when the head is returned to its down position the tape returns to the same position it was in prior to lifting the head. This assures that the leading edge of the adhesive is in the necessary position at the tangent point to initiate dispensing operation. If the tape path shortens when the head 34 is lifted the slack will be taken up by take-up roller 40, and when the head is returned to the down position the leading edge of the adhesive will return to a position forward of the tangent point 35 potentially resulting in device malfunction. As explained above, the complimentary motion of roller 32 is designed to prevent this from occuring by maintaining a constant path length from brake roller 30 to take-up roller 40. In the present embodiment roller 32 is moved by yoke 50 for this purpose. The length and bend of yoke 50 and its pivot point and the size of roller 32 are coordinated so that the tape path length between brake roller 30 and take-up roller 40 remains substantially constant. While the present device utilizes a direct mechanical linkage for tape path compensation, other means for moving roller 32 for this purpose, such as an air piston drive, could also be employed. It is further contemplated that roller 32 could be fixedly mounted to serve its wrap roller function and that an additional, separate roller could be employed for tape path length compensation. Moreover, it is contemplated that roller 36 could be omitted and tape T routed directly up to roller 38 off head 34.

Another important aspect of the present invention is the maintaining of proper unwind tension and take-up, or rewind, tension. It is currently believed that the unwind tension should be equal to the rewind tension for the best results. The tension ranges of the adhesive transfer tape on the unwind side is controlled by the dancer arm 18 and its accompanying spring 17. As long as the dancer arm 18 is able to rotate, the tension in the adhesive transfer tape T can be no larger than the tension range created by the dancer arm spring 17. This tension range is preselected by the size of the spring 17. By the use of the unwind motor 16, proximity switch 22 and cam 24 the dancer arm 18 is able to stay near its neutral position and the preselected tension range. The tension on the adhesive transfer tape on the rewind side is controlled at the take-up roller 40. This can vary depending on the clutch setting, the type of drive or nip roller material used, the size of the two rollers, and by how large a spring is used on the nip roller. The supply side brake roller 30 isolates the unwind from the rewind tension when adhesive is not being transferred. During the transfer of the adhesive the unwind and rewind tension are basically equal (i.e. the rewind only pulls the liner as fast as the adhesive transfer is taking place). In the embodiment of the device disclosed herein, the rewind motor 46 and slip clutch 44 are selected to apply a rewind tension of ½ to 1½ pounds force. Unwind tension is preferably maintained at a corresponding level. Of course, take-up tension must be limited so that it does not exceed a force level which when added to the liner pulling force exerted by product 70 would overcome the resistance of brake roller 30 when the brake is applied.

If a roller head is used for application head 34 it is preferable to use a low friction bearing such as a needle bearing, although a bronze oil impregnated bearing will function with low life expectation. It has also been found to use short air lines between the air valve and the air cylinder 52 to avoid delay in the actuation thereof. The rewind slip clutch assembly 44 is a friction slip clutch as, for example, available as model no. L2-1-312AB from the Hilliard Corporation, Motion Control Division, 100 W. Fourth Street, Elmire, NY 14902. A permanent magnet slip clutch as for example available from Dana, Industrial Power Transmission Division, FORMSPRAGUE-WEBSTER, of Webster, Massachusetts, sold under the brand name Perma-Tork Hollow Shaft Units (HC/EC 2, 4, 5), could also be used. The brake 26 is preferably rated at 5 in./lb. static torque with an armature assembly inertia of 0.007 lbs./in.$^2$. Response time is preferably less than 22 ms.

With the above specified components, tape applicator 10 may be run at speeds of up to 150 ft/min with 3" spot spacing and 3" adhesive spacing. At 70 ft/min the device is capable of 1-⅜" spot spacing and 1-⅜" adhesive spacing. These speeds are obtained without lifting head 34 between applications.

In the drawing of FIG. 1, product 70 is shown conveyed along a conveyor belt 60. Other forms of product conveyance such roller however are equally suitable for use in connection with the device 10 according to the present invention. In any event, however, because the product must provide the force necessary to pull the tape off roll 12, over the rollers and under the head, the conveying system must impart a positive force on the product. Also, it is contemplated that certain of the rollers could be replaced with fixed position guides, or that different systems could be provided to unwind the tape and take-up the liner.

Although the invention has been described herein in its preferred form, those skilled in the art will recognize that many variations and changes may be made thereto without departing from the spirit and scope of the claims appended hereto.

What is claimed is:

1. A method for applying an adhesive transfer tape carried on a roll to a product carried on a conveyor and removing the liner of the tape, comprising the steps of:

a) using an application head, pressing the adhesive transfer tape onto the product carried on the conveyor so that the adhesive carried on the tape liner adheres to the product and so that the product pulls the tape from the roll and over the head as the product moves underneath the head on the conveyor;

b) pulling the liner of the tape away from the application head and from the adhesive adhered to the product so that the transfer of the adhesive from the liner to the product is completed;

c) while the product is moving under the head, selectively stopping the tape from advancing over the head so that the continued movement of the product brakes the adhesive carried on the liner whereby a leading edge of adhesive is formed on the liner; and d) while the liner is pressed against a subsequent product on the conveyer, releasing the stopped tape so that the advance of the product under the head catches the leading edge of the adhesive on the liner, and repeating steps (a) and (b).

2. A method according to claim 1 further including the step of maintaining a substantially constant unwind tension for the tape.

3. The method according to claim 1 further wherein the liner is removed using a predetermined, constant liner removal force and using rapid acceleration of the liner.

4. The method according to claim 1, wherein the head is moved between a first position pressing the tape onto the product and a second retracted position.

5. The method according to claim 4 further wherein when the head is returned to the first position from the second position, the tape position is adjusted to provide that the leading edge of the adhesive on the tape returns to the tangent point of the head so that it can catch on the product moving underneath the head.

6. The method according to claim 5 further including the step of moving the head from the first position to the second position after the advance of the tape has been stopped and returning the head from the second position to the first position prior to the release of the tape.

* * * * *